US007321340B1

(12) United States Patent
Sergi et al.

(10) Patent No.: US 7,321,340 B1
(45) Date of Patent: Jan. 22, 2008

(54) MULTIPURPOSE ANTENNA HUB

(75) Inventors: Paul D. Sergi, Peninsula, OH (US); Edward L. Merical, Canal Fulton, OH (US); Brian C. Carruth, Burbank, OH (US)

(73) Assignee: PDS Electronics, Inc., Akron, OH (US)

( * ) Notice: Subject to any disclaimer, the term of this patent is extended or adjusted under 35 U.S.C. 154(b) by 22 days.

(21) Appl. No.: 11/074,234

(22) Filed: Mar. 7, 2005

(51) Int. Cl.
*H01Q 1/12* (2006.01)

(52) U.S. Cl. ..... 343/890; 343/715

(58) Field of Classification Search ..... 343/713, 343/715, 711, 878, 890–891
See application file for complete search history.

(56) References Cited

U.S. PATENT DOCUMENTS 2,445,336 A * 7/1948 Rauch ..... 343/890
4,691,209 A * 9/1987 Kershaw ..... 343/846
4,743,917 A * 5/1988 Huntsman et al. ..... 343/877
6,313,800 B1 * 11/2001 Kallina ..... 343/715
6,750,824 B1 * 6/2004 Shen ..... 343/713
7,002,525 B1 * 2/2006 Sergi ..... 343/715
7,030,831 B2 * 4/2006 Nilsson ..... 343/840

OTHER PUBLICATIONS

Drawings from U.S. Appl. No. 10/774,654, filed Feb. 9, 2004 (3 sheets).

* cited by examiner

*Primary Examiner*—Huedung Mancuso
(74) *Attorney, Agent, or Firm*—Renner, Kenner, Greive, Bobak, Taylor & Weber

(57) ABSTRACT

A hub assembly (10) includes a hub (12) which can be attached to the mast (11) of an antenna by fastening assemblies (41) at a selected position along the mast (11). The hub (12) can carry rods (46) in horizontal slots (39, 40) to form a capacitance hat for the antenna, or can carry rods (46) in vertical slots (37, 38) so that the rods (46) can be positioned to overlie a trap (51) by a selected extent to tune the trap (51) a selected amount. Clamping assemblies (47) hold the rods (46) in the selected slots (37-40). Apertures (36) are provided in the hub (12) and are adapted to receive guy wires to support the antenna.

15 Claims, 3 Drawing Sheets

MULTIPURPOSE ANTENNA HUB

TECHNICAL FIELD

This invention relates to a hub for an antenna. More particularly, this invention relates to a hub which can be used for multiple purposes with an antenna to, for example, attach a capacitance hat to the mast of an antenna, to carry wires to adjust the capacitance of a trap of an antenna, or to support the guy wires which stabilize an antenna.

BACKGROUND ART

In order to connect items such as a capacitance hat of an antenna to the mast of the antenna, some type of hub or other interconnection device is required. Typically, these devices have served that single purpose, that is, to connect the components of the capacitance hat to the mast of an antenna. Thus, to date, no hub or capacitance hat connection device has been designed which can be used for other purposes as well.

Some antennas have "traps," which include a capacitor and inductor connected in parallel that act as filters and block all frequencies less than the frequency of a particular interest. The capacitance and inductance values are chosen so that at the radio frequency of interest, the impedance of the inductor is equal to, and opposite in size to, the impedance of the capacitor. A resonant circuit passes radio frequency current easily from the capacitor to the inductor, and back, but prevents radio frequency current from flowing across the circuit as a whole. When a resonant trap is placed in series with a section of an antenna, the antenna is efficiently segmented at the insertion point of the trap at the frequency at which the trap is resonant. To change the resonant frequency being blocked by a trap, the user must either add more traps, or use different traps. Heretofore, traps that are tunable to a particular frequency have not been practically provided.

DISCLOSURE OF THE INVENTION

It is thus an object of the present invention to provide a hub which can be selectively used with an antenna to perform several functions.

It is another object of the present invention to provide a hub, as above, which can carry the wires or rods which constitute an antenna capacitance hat at a desired position along the mast of the antenna.

It is a further object of the present invention to provide a hub, as above, which can optionally carry wires or rods that can be used to tune a trap on an antenna.

It is an additional object of the present invention to provide a hub, as above, which can potentially be used to hold guy wires which stabilize the antenna.

These and other objects of the present invention, as well as the advantages thereof over existing prior art forms, which will become apparent from the description to follow, are accomplished by the improvements hereinafter described and claimed.

In general, in accordance with one aspect of the present invention, a hub assembly is adapted to be carried on the mast of an antenna and includes ring-shaped hub. The hub has an inner surface adapted to receive the mast and an outer surface having a plurality of faces. Slots are provided in at least some of the faces and are adapted to receive antenna rods.

In a similar fashion, the present invention contemplates an antenna including a mast and a ring-shaped hub carried by the mast. The hub has a plurality of outer faces, and slots are provided in at least some of the faces, the slots carrying rods.

In accordance with another aspect of the present invention, a hub assembly adapted to be carried on the mast of an antenna includes a hub which is adapted to carry a plurality of rods. The hub has top and bottom surfaces and apertures extending between these surfaces. The apertures are adapted to receive guy wires.

A trap which can be carried at a position along the mast of an antenna can be tuned by a method of the present invention which includes the step of positioning one or more rods at a selected position adjacent to the trap to tune the trap.

A preferred exemplary hub for an antenna according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
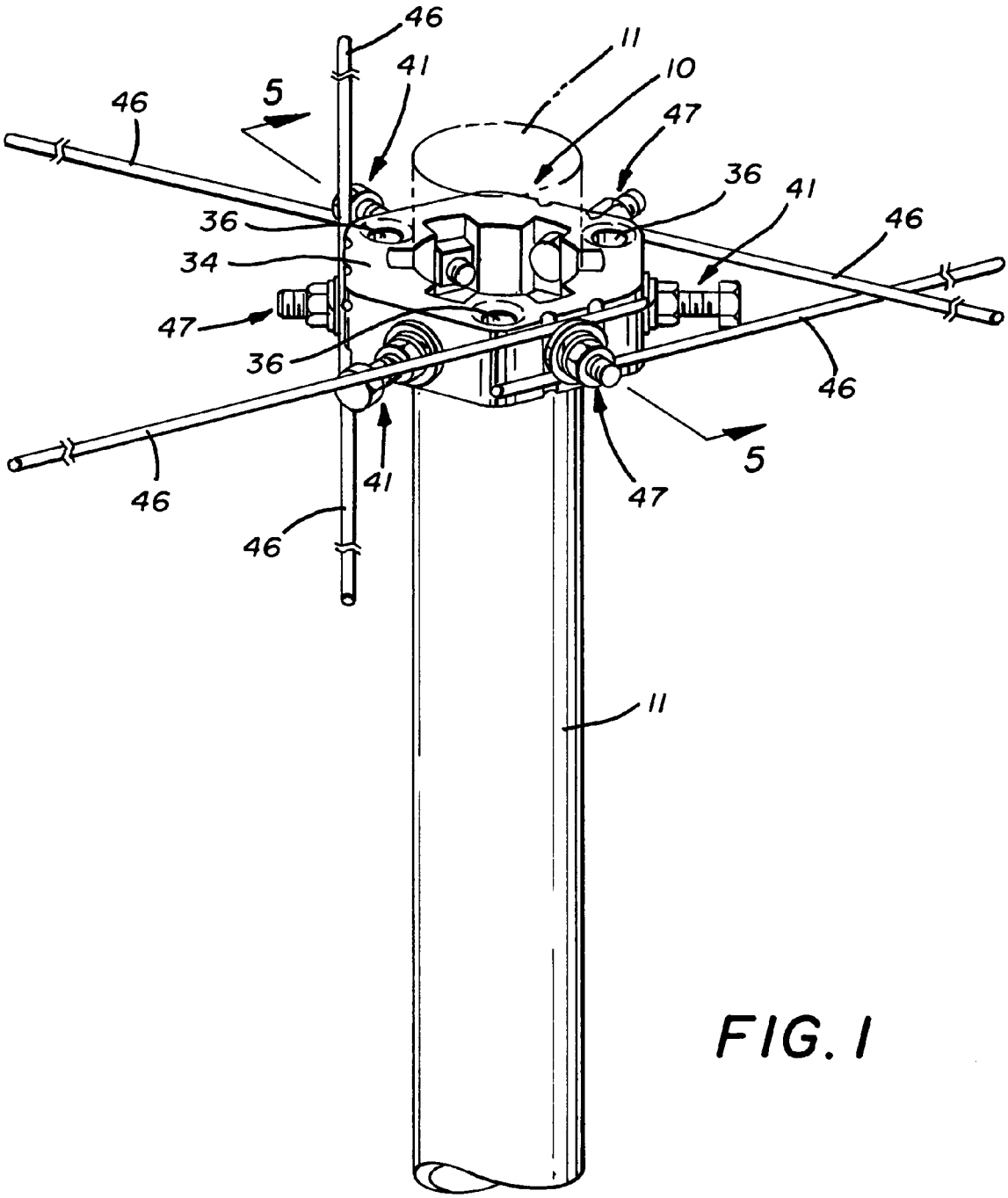
FIG. 1 is a fragmentary perspective view of the area near the top of an antenna showing a hub assembly made in accordance with the present invention being used to carry a capacitance hat.
Figure 2:
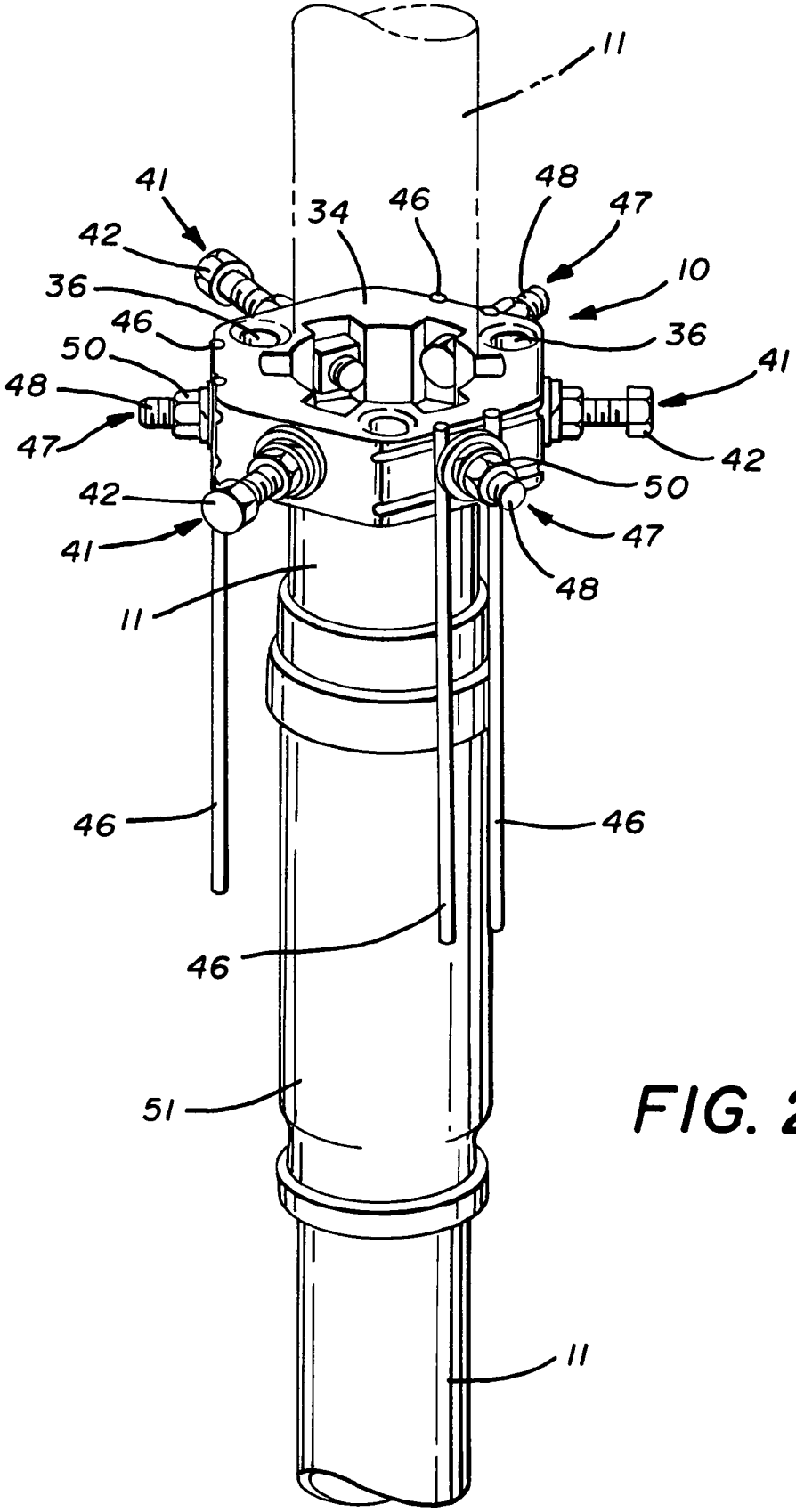
FIG. 2 is a fragmentary perspective view of a portion of an antenna showing the manner in which the hub assembly of the present invention may be used to tune an antenna trap.

A hub assembly made in accordance with the concepts of the present invention is indicated generally by the numeral 10 and is shown in FIGS. 1 and 2 as being used in conjunction with a vertical mast 11 of an antenna. While being shown in conjunction with a vertical antenna, it is to be understood that hub assembly 10 has applicability to any antenna configuration, such as a horizontal antenna, and when a mast 11 is referred to herein, it is to be appreciated that the mast 11 need not be vertically oriented.

Figure 3:
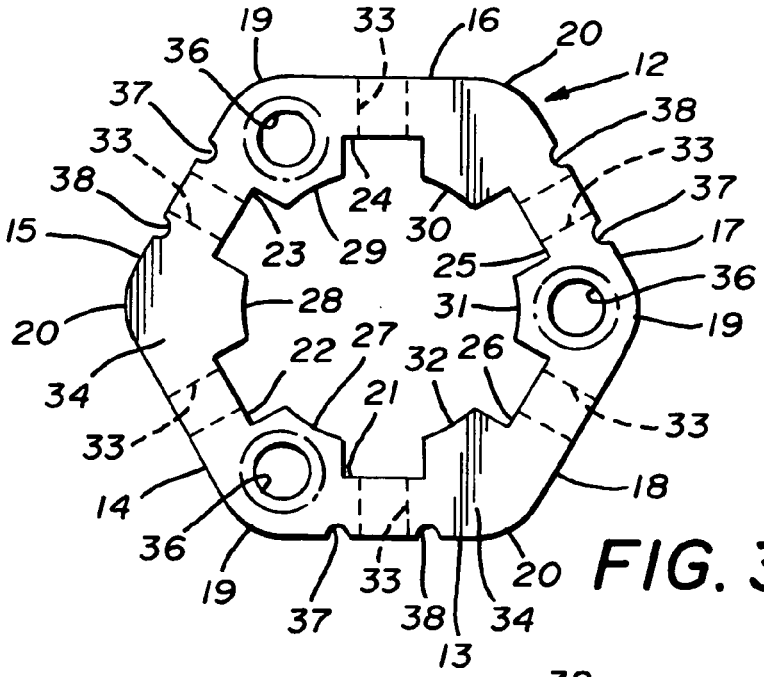
FIG. 3 is a top plan view of a hub made in accordance with the present invention.
Figure 4:
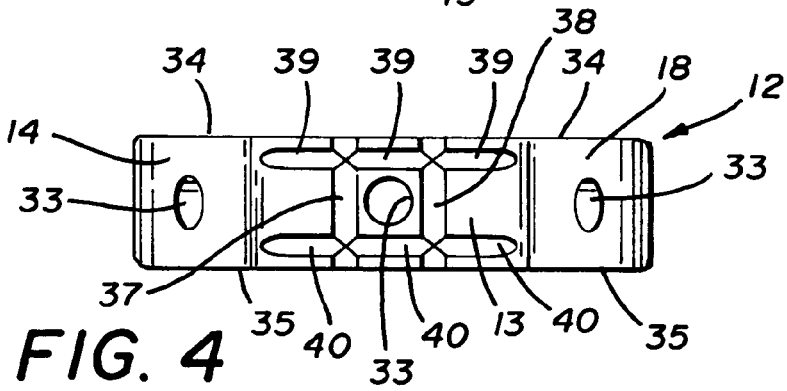
FIG. 4 is a side elevational view of the hub of FIG. 3.

Hub assembly 10 includes a hub generally indicated by the numeral 12 and shown in FIGS. 3 and 4. Hub 12 can be made out of any material of suitable strength, such as a heat treated aluminum or the like, and is generally ring-shaped with a preferably generally hexagonal outer surface. Thus, hub 12 is formed with generally flat outer faces 13, 14, 15, 16, 17 and 18. Each outer face 13-18 is interconnected with its adjacent outer face 13-18 by outer arcuate surfaces 19 or 20. The inner surface of hub 12 is somewhat castellated in shape having crenels 21, 22, 23, 24, 25 and 26 alternating with curved merlons 27, 28, 29, 30, 31 and 32. Merlons 27-32 are positioned opposite to either arcuate surface 19 or arcuate surface 20, and crenels 21-26 are positioned opposite to outer faces 13-18, respectively. Apertures 33 extend through each outer surface 13-18 to crenels 21-26.

Hub 12 is also provided with opposed top and bottom surfaces 34, 35. Thus, surfaces 34 and 35 define to top and bottom of outer faces 13-18, arcuate surfaces 19 and 20, crenels 21-26, and merlons 27-32. A plurality of apertures 36 extend through hub 12 from top surface 34 to bottom surface 35. Three such apertures 36 are shown as being positioned between outer arcuate surfaces 19 and curved merlons 27, 29 and 31, although if desired, more apertures could be provided at the areas between outer arcuate surfaces 20 and curved merlons 28, 30 and 32. Apertures 36 are shown as being dished or countersunk at top and bottom surfaces 34, 35 as will be more fully hereinafter described.

As best shown in FIGS. 3 and 4, outer faces 13, 15 and 17 are each provided with spaced vertical slots 37, 38 extending from top surface 34 to bottom surface 35. Outer faces 14, 16 and 18 could be provided with similar slots, if desired. As shown, slots 37 and 38 are strategically positioned on each side of aperture 33 in each face 13, 15 and 17. The faces which are provided with slots 37 and 38, that is, in this instance, faces 13, 15 and 17, are also provided with horizontally extending spaced slots 39 and 40. Faces 14, 16 and 18 could also be provided with similar slots, if desired. As shown, slots 39 and 40 are strategically positioned on each side of aperture 33 in each face 13, 15 and 17, and slots 39 and 40 intersect slots 37 and 38.

Hub 12 is adapted to be attached to the mast 11 of an antenna. As such, hub assembly 10 includes a plurality of fastening assemblies generally indicated by the numeral 41 and best shown in FIG. 5. There are preferably three fastening assemblies 41, each spaced approximately one hundred twenty degrees of each other around hub 12 and received through apertures 33 in outer faces 14, 16 and 18, the faces which are not provided with slots 37-40. Each fastening assembly 41 includes a bolt 42 having a threaded shaft which passes through an aperture 33 in hub 12. A nut 43 is threaded onto the shaft of bolt 42 and is received in a crenel 22, 24 and 26. A lock washer 44 and lock nut 45 are received on the shaft of bolt 42 and are positioned adjacent to faces 14, 16 and 18.

Figure 5:
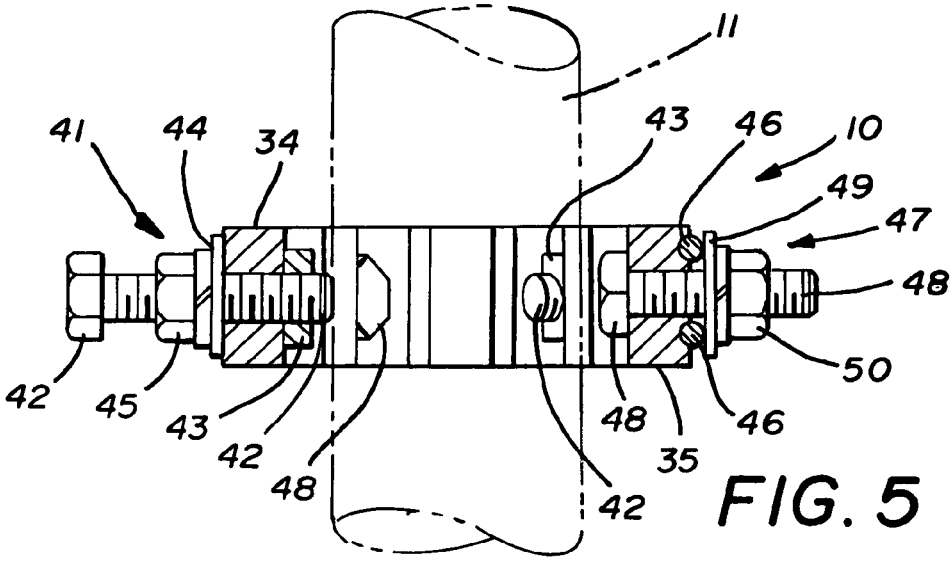
FIG. 5 is a sectional view taken substantially along line 5-5 of FIG. 1.

To attach hub 12 to mast 11, hub 12 is first positioned at the desired location along mast 11 and then bolts 42 are tightened. Nuts 43 will not turn because of their position in crenels 22, 24 and 26. When so tightened, the ends of the shafts of bolts 42 engage mast 11, as shown in FIG. 5, and merlons 27-32 likewise engage mast 11. The curved surfaces of merlons 27-32 are designed to match or approximate the circumference of mast 11, and thus, mast 11 is fully engaged by hub 12. Once all of the bolts 42 are tightened, the lock nuts 45 may be tightened to prevent the loosening of bolts 42. To remove hub 12 from mast 11, or to change the position thereof along mast 11, one need only first loosen lock nuts 45 and then loosen bolts 42.

As shown in FIG. 1, when used in conjunction with a vertical antenna, hub 12 may be positioned near the top of the antenna mast 11 when it is desired to utilize hub assembly 10 to carry the wires or rods 46 which are positioned to form a capacitance hat. Hub 12 can carry up to six rods 46 in slots 39 and 40 such that they are parallel to each other and to the ground. The rods 46 are positioned in pairs and extend in opposite directions from faces 13, 15 and 17. Thus, the pairs of rods 46 extend outwardly from mast 11 at one hundred twenty degrees of each other. The inner ends of each pair of rods 46 are positioned in slots 39 and 40, and by virtue of this configuration, rods 46 may be positioned to extend from hub 12 in six directions in a horizontal plane without interfering with each other. The manner in which rods 46 are held in place in slots 39 and 40, and thus carried by hub 12, is best shown in FIG. 5.

To that end, hub assembly 10 includes a plurality of clamping assemblies generally indicated by the numeral 47. There are preferably three clamping assemblies each spaced approximately one hundred twenty degrees of each other and received through apertures 33 in outer faces 13, 15 and 17, the faces which are provided with slots 37-40. Each clamping assembly 47 includes a bolt 48 having a shaft received through an aperture 33 and a head received in a crenel 21, 23 or 25 so that it cannot rotate. A washer 49 and nut 50 are positioned on the shaft of each bolt 48 adjacent to faces 13, 15 and 17, and when nut 50 is tightened onto bolt 48, washer 49 clamps the ends of rods 46 in place in slots 39 and 40, as shown in FIG. 5.

As shown in FIG. 2, clamping assemblies 47 can also be used to hold rods 46 in slots 37 and 38 in a vertical orientation. In this instance, any number of wires or rods 46, from one to six, can be held in slots 37 and 38 in exactly the same manner as clamping assemblies 47 hold the rods 46 in a horizontal fashion, except when held vertically, it is preferable that all rods 47 extend either upwardly or downwardly from hub 12 rather than extending in both directions from hub 12 as is the situation with horizontal rods in the capacitance hat configuration.

Thus, as shown in FIG. 2, rods 46 extend downwardly over a trap 51 carried by mast 11. As previously described, a trap is a device which includes an inductance and a capacitance connected in parallel which effectively disconnects the antenna feed wire beyond the trap at the resonant frequencies. Typically, the outer casing of the trap forms its capacitance component. Oftentimes the user may desire to change that frequency which would require either providing a multi-band unit with multiple traps, or would require that the trap 51 be changed.

In accordance with the present invention, hub 12 may be used to carry rods 46, as shown in FIG. 2, to tune trap 51 to a different frequency. In this novel approach, the portion of rods 46 which overlaps trap 51 adds capacitance to that established by the outer casing of the trap 51, thereby adding capacitance to the resonant circuit, which lowers the frequency of which the trap resonates. The more rods 46 that are carried by hub 12, and/or the more overlap that is provided, and/or the larger the diameter of the rods, the lower the frequency. Thus, if one uses six rods 46 and lowers hub 12 on mast 11 such that the rods 46 overlap essentially the entire trap 51, the maximum tuning to a lower frequency can be accomplished. As a result, the present invention allows the user to move hub 12 up and down vertically on mast 11 with rods 46 overlapping trap 51, until the trap 51 is turned to the desired resonant frequency. Then hub 12 may be locked in place on mast 11 at that location by tightening the bolts 42 of each clamping assembly 41. As a result, coarse or fine changes in the characteristics of the trap 51 may be made by simply varying the number, size, or length of overlap of the rods 46.

Hub 12 of the present invention may also be used to hold guy wires, cables or ropes to stabilize the a vertical mast 11. As is known in the art, guy wires are items that are attached at the ground and to the mast of an antenna near the top thereof to prevent the mast from falling or otherwise tipping. Apertures 36 on hub 12 provide a recess to attach the guy wires, cables or ropes to hold the mast 11, to which the hub 12 is connected, steady. The fact that apertures have a dished out area or are countersink at surfaces 34 and 35, as previously described, assures that there are no sharp surfaces or corners which might otherwise abrade the guy wires.

In view of the foregoing, it should be appreciated that a hub assembly constructed as described herein accomplishes the objects of the invention and otherwise substantially improves the art.

What is claimed is:

1. A hub assembly adapted to be carried on the mast of an antenna comprising a ring-shaped hub having an inner surface adapted to receive the mast and an outer surface having a plurality of faces, spaced generally horizontally oriented first slots provided in at least some of said faces and adapted to receive antenna rods, spaced generally vertically oriented second slots provided in at least some of said faces and adapted to receive antenna rods, an aperture in said some of said faces between said first slots and between said second slots, a bolt received in each said aperture, and a washer received around each said bolt and adapted to engage the rods, positioned in either said first slots or said second slots.

2. The hub assembly of claim 1 wherein said hub includes top and bottom surfaces, and a plurality of apertures extending between said top and bottom surfaces, said apertures being adapted to receive guy wires.

3. The hub assembly of claim 2 wherein said apertures are dished at said top and bottom surfaces.

4. A hub assembly adapted to be carried on the mast of an antenna comprising a hub having an inner surface adapted to receive the mast and an outer surface having a plurality of faces, and slots provided in at least some of said faces and adapted to receive antenna rods, generally horizontally oriented first slots formed in said hub and adapted to receive said rods, generally vertically oriented second slots formed in said hub and adapted to receive said rods, said inner surface including merlons adapted to engage the mast, and crenels between said merlons.

5. The hub assembly of claim 4 further comprising a fastening assembly to hold said hub on the mast.

6. The hub assembly of claim 5 wherein said crenels are positioned adjacent to said faces and further comprising an aperture extending through at least some of said faces to said crenels, said fastening assemblies including a bolt received in said aperture and adapted to engage the mast.

7. The hub assembly of claim 6 wherein said fastening assembly includes a nut received on said bolt and positioned in a said crenel so that said nut will not rotate when said bolt is rotated to attach said hub to the mast.

8. The hub assembly of claim 6 further comprising additional apertures extending through other of said faces to said crenels, and clamping assemblies including a bolt received through said additional apertures and adapted to hold the rods.

9. An antenna comprising a mast, a ring-shaped hub carried by said mast, said hub having a plurality of outer faces, generally horizontally oriented slots provided in at least some of said faces, additional slots in some of said faces, said additional slots being generally vertically oriented, and rods carried in selected of said slots or said additional slots.

10. The antenna of claim 9 further comprising an aperture in said some of said faces, and a clamping assembly including a bolt received in each said aperture and holding said rods in said slots or said additional slots.

11. The antenna of claim 10, said hub having an inner surface opposed to said outer faces, said inner surface including alternating merlons and crenels, said merlons engaging said mast.

12. The antenna of claim 11 wherein said clamping assembly includes a nut received in said crenels.

13. The antenna of claim 9 wherein said hub includes top and bottom surfaces, and a plurality of apertures extending between said top and bottom surfaces, said apertures being adapted to receive guy wires.

14. A hub assembly adapted to be carried on the mast of an antenna comprising a hub, said hub being adapted to carry a plurality of rods, generally horizontally oriented first slots formed in said hub and adapted to receive said rods, generally vertically oriented second slots formed in said hub and adapted to receive said rods, said hub having top and bottom surfaces, and apertures extending between said surfaces and adapted to receive guy wires.

15. The hub assembly of claim 14 wherein said upper and lower surfaces are dished at said apertures.

* * * * *